United States Patent [19]

Raupuk, Jr. et al.

[11] Patent Number: 4,520,513

[45] Date of Patent: Jun. 4, 1985

[54] AUTOMATIC VACUUM URINAL FLUSH MECHANISM

[75] Inventors: Milton W. Raupuk, Jr., Annapolis; Edward M. Pennington, Chester, both of Md.

[73] Assignee: The United States of America as represented by the Secretary of the Navy, Washington, D.C.

[21] Appl. No.: 500,509

[22] Filed: Jun. 2, 1983

[51] Int. Cl.[3] ..... E03D 13/00

[52] U.S. Cl. ..... 4/302; 4/DIG. 3; 4/313; 4/316; 4/354

[58] Field of Search ..... 4/302, 303, 313, 305, 4/316, 354, DIG. 3; 137/205, 308, 487.5

[56] References Cited

U.S. PATENT DOCUMENTS

| | | | |
|---|---|---|---|
| 3,329,974 | 7/1967 | Belasco et al. | 4/316 |
| 3,628,194 | 12/1971 | Liljendahl | 4/10 |
| 3,628,195 | 12/1971 | Skousgaard | 4/354 |
| 3,777,778 | 12/1973 | Janu | 137/487.5 |
| 3,853,138 | 12/1974 | Amren | 137/1 |
| 3,995,328 | 12/1976 | Pardan et al. | 4/316 |
| 4,184,506 | 1/1980 | Varis et al. | 137/205 |
| 4,196,481 | 4/1980 | Swanda | 4/308 |
| 4,275,470 | 6/1981 | Badger et al. | 4/316 |

*Primary Examiner*—Henry K. Artis

*Attorney, Agent, or Firm*—Robert F. Beers; Luther A. Marsh

[57] ABSTRACT

An automatic flushing apparatus for vacuum flow system urinals. A pressure sensing switch responds to the hydrostatic pressure resulting from one or two urinations and directs the system vacuum to both a water dispensing valve and the main discharge valve to automatically flush the system with a measured amount of water to prevent odors and soil drain scale buildup.

8 Claims, 2 Drawing Figures

AUTOMATIC VACUUM URINAL FLUSH MECHANISM

SUMMARY OF THE INVENTION

The present invention is particularly directed to providing a means for automatically depositing a volume of flush water into vacuum collection system urinals after each use, or alternate uses, to prevent the buildup of soil drain scale to improve reliability and maintainability, and to reduce offensive odors. This is accomplished by replacing the manually activated flushometer with a vacuum-triggered water dispensing valve located between the water supply and the urinal. This valve is opened by the same vacuum signal initiated by the pressure switch that controls the operation of the flow line discharge valve. In operation the increased fluid pressure resulting from one or two urinations activates a pressure switch located between the urinal and the discharge valve. The pressure switch then directs vacuum from the system through a discharge timing controller which has an atmosphere bleeder valve assembly and which is connected to the vacuum operated discharge valve to open it for a predetermined period during which the urinal is evacuated into the vacuum collection tank. A second vacuum line from the discharge timing controller activates the water dispensing valve to deposit a sufficient quantity of flush water into the urinal to prevent scale buildup.

The changes to existing vacuum collection systems consist first of fixing the volume of flush water deposited into the urinal after a fixed amount of urine has accumulated; and second, replacing the manual flushometer with a vacuum triggered water dispensing valve to automatically discharge a sufficient supply of water to prevent scale buildup in the system.

BACKGROUND OF THE INVENTION

The invention relates to an automatic flushing mechanism and particularly to the automatic dilution and evacuation of urinals installed in a vacuum collection system.

Vacuum collection, or sewer, systems afford attractive advantages over gravity collection, holding, and transfer systems, particularly for shipboard applications where weight constraints are restrictive. Vacuum systems require significantly reduced volumes of flush water, require little space, can be designed to use substantially smaller and lighter piping, and result in both smaller and lighter holding tank facilities and longer periods of independence from shore support.

Existing vacuum urinals require manually operated reduced-volume flushometers to deposit a measured amount of water into the urinal. This triggers a pressure switch that diverts system vacuum through a discharge timing controller to open the flow line discharge valve for an interval of time sufficient to evacuate the line. Flushing is frequently neglected because water does not stand visibly in the bowls of vacuum flush urinals. In addition, flushometers in heavy usage environments, such as Navy ships, require excessive maintenance. As a result volumes of flushing water are often inadequate to prevent offensive odors and scale buildup in the soil drain lines of the system. The required corrective maintenance, either acid cleaning or hydroblasting, is expensive and time-consuming, and generally entails shore-based facilities and support. Laboratory studies indicate that a minimum volumetric flushing water-to-urine dilution ratio of about 1.5 will prevent soil drain line scaling.

It is therefore an object of this invention to provide a means whereby urinals which are part of a vacuum collection system will be automatically flushed by the deposit of a measured amount of water after a predetermined amount of urine has passed through the urinal.

It is further an object to provide vacuum collection system urinals with an automatic flushing capability to reduce scale buildup in soil drain pipes and reduce associated odors and maintenance.

Other objects, advantages and novel features of the invention will become apparent from the following detained description of the invention when considered in conjunction with the accompanying drawings wherein:

DESCRIPTION OF THE PREFERRED EMBODIMENT

Figure 1:
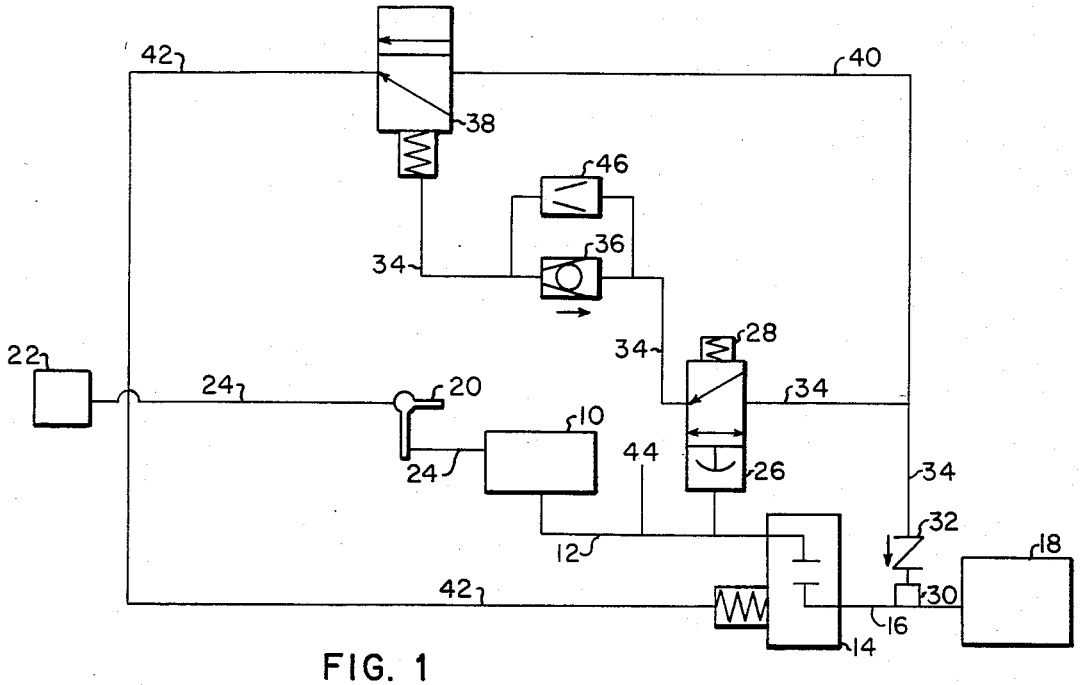
FIG. 1 PRIOR ART
FIG. 1 is a schematic representation of prior art vacuum operated sewage flow systems with manual flushometer.

In the prior art system schematic of FIG. 1, a urinal, 10, is connected by input flow line, 12, to a main discharge valve, 14, which is normally closed, and from the main discharge valve through the output flow line, 16, to the vacuum collector tank, 18, that also serves as the system vacuum source. When the manual flushometer, 20, is activated, flush water from a source, 22, flows through conduit, 24, into the urinal and to the main discharge valve. This causes an increase in the hydrostatic pressure acting on a pressure-sensing device, 26, which can be of the diaphragm or buoyant float type. The diaphragm or float rises to depress the plunger on a normally closed vacuum switch, 28. Vacuum switch, 28, then opens and diverts vacuum, tapped off the main system through a connector tap, 30, check valve, 32, and tubing, 34, through a checking device, 36, to act on the normally closed pneumatically-triggered discharge timing controller, 38. Triggering of the timing controller directs system vacuum from connector tap, 30, through tubing, 34, 40, and 42, to the main discharge valve, 14, which then opens, permitting the flow of the entrained liquid due to inrushing air into the urinal or into a dedicated vent, 44, in flow line, 12, through the main discharge valve and into the vacuum collector tank. The flow through the main discharge valve results in a reduction of the hydrostatic pressure acting on the pressure-sensing device, 26, which allows the vacuum switch, 28, to return to a closed position. An orifice, or jet, 46, and the checking device, 36, permit atmospheric air to be admitted at a controlled rate to the discharge timing controller, 38, restoring it to its at-rest, or closed, position. In this position, atmospheric air is vented into the main discharge valve, 14, which returns to a closed position, completing the cycle. The time to complete the cycle is controlled by the rate at which the orifice or jet permits the vacuum acting on the discharge timing controller, 38, to dissipate.

Figure 2:
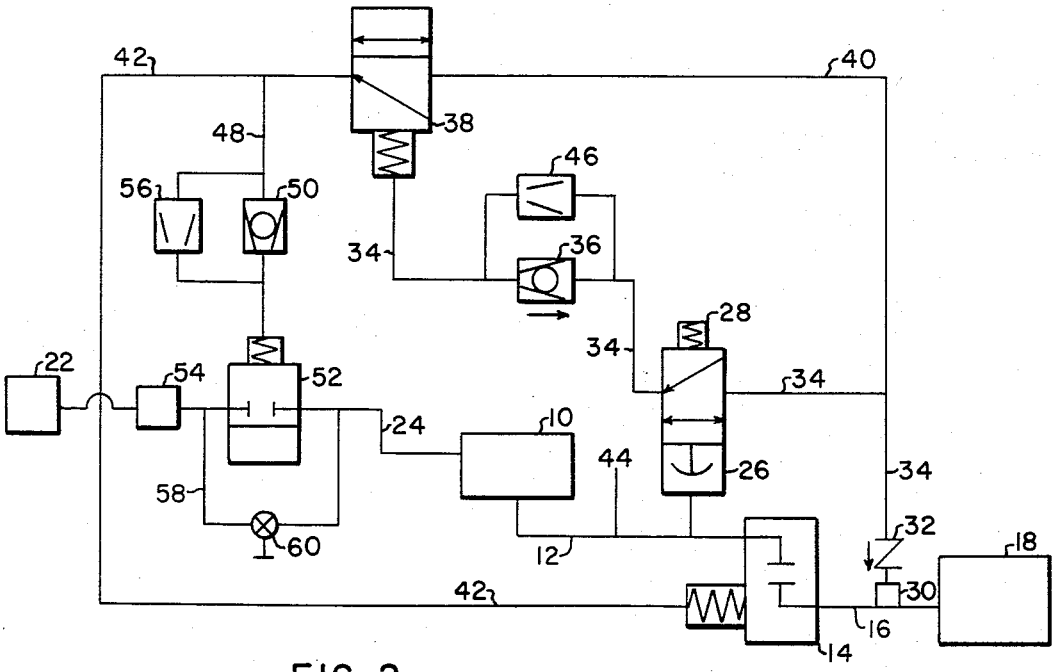
FIG. 2 is a schematic of a vacuum operated sewage flow system modified to incorporate automatic flushometer operation in accordance with the present invention.

In FIG. 2, the replacement of the manual flushometer by the automatic flushometer of the present invention is shown schematically. In this modified system, the pressure sensing device, 26, is set to respond to the hydrostatic pressure resulting from one or two urinations (375 milliliters per urination, average) rather than that resulting from a manually activated flushometer. When the preset pressure is reached, the pressure sensing device, 26, opens the vacuum switch, 28, which diverts vacuum tapped off the main system via connector tap, 30, check valve, 32, and tubing, 34, through a first checking device, 36, to act on the normally closed, pneumatically-triggered discharge timing controller, 38. Triggering of the timing controller directs system vacuum from connector tap, 30, check valve, 32, through tubing, 34, 40, and 42, to open the main discharge valve, 14, as in the prior art systems, permitting the flow of entrained liquid due to inrushing air into the urinal, 10, or into a dedicated vent, 44, in flow line, 12. The opening of the discharge timing controller, 38, also directs vacuum through tubing, 48, to a second checking device, 50, to activate a normally closed water dispensing valve, 52, which permits flush water from water source, 22, to flow through a flow regulator, 54, at a constant rate through conduit, 24, and into the urinal, 10, which drains through input flow line, 12, to the main discharge valve, 14, and through the output flow line, 16, to the vacuum collector tank, 18. As in the prior system, the drop in hydrostatic pressure resulting from the opening of the main discharge valve, 14, relieves the pressure sensing device, 26, and the vacuum switch, 28, returns to the closed position. Atmospheric air admits into the discharge timing controller through a first orifice, or jet, 46, and first checking device, 36, and then into the main discharge valve, and they each return to their normal closed positions. With the discharge timing controller closed, atmospheric air is vented at a controlled rate through a second orifice or jet, 56, into the water dispensing valve, 52, which returns to a closed position, stopping the flow of water, and completing the cycle. The interval during which flush water is deposited into the urinal is controlled by the rate at which the orifice or jet, 56, permits the vacuum acting on the water dispensing valve to dissipate. This interval and the flow rate of the water through the flow regulator, 54, permits dispensing a constant and controlled amount of flush water into the urinal for each discharge valve, 14, activation. A manual valve, 60, connected by conduit, 58, bypassing the water dispensing valve, 52, is provided to manually deposit water into the urinal for cleaning and maintenance purposes.

The entire operation of the urinal is thus automatic assuring regular timely flushing of the system to prevent odors and scale buildup in the soil drain lines. The automatic flushing means is simple and compact and readily applicable to existing installations using conventional components.

Obviously many modifications and variations of the present invention are possible in light of the above teachings. It is therefore to be understood that within the scope of the appended claims the invention may be practiced otherwise than as specifically described.

What is claimed is:

1. In a vacuum sewage flow system of the type characterized by a manual flushometer that admits water into a urinal, a pressure sensing device that responds to the increased hydrostatic pressure resulting from the flush water, a vacuum switch that opens in response to the pressure sensing device, a discharge timing controller activated by and connected to system vacuum through said vacuum switch and through a check valve and orifice device, and a main discharge valve activated by and connected to system vacuum through said discharge timing controller such that the opening of the main discharge valve permits flow from the urinal which drops the hydrostatic pressure, resets both the pressure sensing device and vacuum switch and admits atmospheric pressure through the said orifice to the timing controller and main discharge valve to reset the system to its original status the improvement comprises:

a vacuum controlled water dispensing valve;

an additional vacuum line connecting the discharge timing controller to the vacuum controlled water dispensing valve so that flush water is introduced into the urinal in response to the activation of the pressure sensing switch.

2. In the vacuum sewage flow system of claim 1 wherein a second check valve and orifice device is inserted in the vacuum line between the discharge timing controller and the vacuum controlled water dispensing valve.

3. In the vacuum sewage flow system of claim 1 wherein a flow regulator device is inserted in the input flow line between the flushwater source and the urinal.

4. In the vacuum sewage flow system of claim 1 wherein a manually operated valve is connected to the input flow line to bypass the water dispensing valve.

5. In the vacuum sewage flow system of claim 1 wherein the pressure sensing device which activates the vacuum switch responds to a hydrostatic pressure increase resulting from the addition of 250 to 500 milliliters of urine into the urinal.

6. In the vacuum sewage flow system of claim 1 wherein the pressure sensing device which activates the vacuum switch responds to a hydrostatic pressure increase resulting from the addition of 500 to 1000 milliliters of urine into the urinal.

7. In the vacuum sewage flow system of claim 1 wherein a single water dispensing valve controls the flow of flushwater to a plurality of urinals.

8. In a vacuum sewage flow system of the type characterized by a manual flushometer that admits water into a urinal, a pressure sensing device that responds to the increased hydrostatic pressure resulting from the flush water, a vacuum switch that opens in response to the pressure sensing device, a discharge timing controller activated by and connected to system vacuum through said vacuum switch and through a check valve and orifice device, and a main discharge valve activated by and connected to system vacuum through said discharge timing controller such that the opening of the main discharge valve permits flow from the urinal which drops the hydrostatic pressure, resets both the pressure sensing device and vacuum switch and admits atmospheric pressure through the said orifice to the timing controller and main discharge valve to reset the system to its original status the improvement comprises:

a vacuum controlled water dispensing valve;

an additional vacuum line connecting the discharge timing controller to the vacuum controlled water dispensing valve so that flush water is introduced into the urinal in response to the activation of the pressure sensing switch;

a second check valve and orifice device is inserted into the vacuum line between the discharge timing controller and the vacuum controlled water dispensing valve;

a flow regulator device is inserted in the input flow line between the flushwater source and the urinal;

a manually operated valve is connected to the input flow line to bypass the water dispensing valve;

the pressure sensing device responds to the increased pressure resulting from the addition of about 250 to 1000 milliliters of urine into the urinal.

* * * * *